US005797772A

United States Patent [19]

Sakurai et al.

[11] Patent Number: 5,797,772

[45] Date of Patent: Aug. 25, 1998

[54] CONNECTOR PROVIDED WITH A RETAINER

[75] Inventors: Toshikazu Sakurai; Izumi Suzuki; Hitoshi Okumura, all of Yokkaichi, Japan

[73] Assignee: Sumitomo Wiring Systems, Ltd., Japan

[21] Appl. No.: 816,655

[22] Filed: Mar. 13, 1997

[30] Foreign Application Priority Data

Mar. 13, 1996 [JP] Japan ..... 8-056524

[51] Int. Cl.[6] ..... H01R 13/436

[52] U.S. Cl. ..... 439/752

[58] Field of Search ..... 439/752, 595

[56] References Cited

U.S. PATENT DOCUMENTS 5,252,096 10/1993 Okada ..... 439/752

5,462,458 10/1995 Sagawa ..... 439/752

5,474,477 12/1995 Aoyama ..... 439/752

5,503,573 4/1996 Sagawa ..... 439/752

5,562,500 10/1996 Tsukakoshi ..... 439/752

*Primary Examiner*—Gary F. Paumen

*Attorney, Agent, or Firm*—Anthony J. Casella; Gerald E. Hespos; Ludomir A. Budzyn

[57] ABSTRACT

A connector is provided with a retainer 30 which can be held displaceably from a partial lock position to a full lock position with respect to a housing 10. An inadvertent movement of the retainer 30 from the partial lock position to the full lock position is prevented by providing a locking control member 34. Accordingly, the retainer 30 does not make an inadvertent movement even if it is struck against something, e.g. during transportation.

10 Claims, 7 Drawing Sheets

CONNECTOR PROVIDED WITH A RETAINER

BACKGROUND OF THE INVENTION

1. Field of the Invention.

The present invention relates to a connector provided with a retainer and, particularly to a connector provided with a retainer designed to doubly lock terminal fittings.

2. Description of the Prior Art.

A known connector, as shown in FIGS. 10 to 12, includes a housing 1 of substantially rectangular boxlike shape. A plurality of terminal fitting chambers 2 extend through the prior art housing 1 along forward and backward directions. The upper surface of the housing 1 is formed with a retainer insertion opening 3 for permitting the insertion of a lattice-shaped retainer 4. A partial locking claw 5 and a full locking claw 6 are formed on a rear end side of each side surface of the retainer 4 with respect to its insertion direction. The locking claws 5, 6 are both engageable with corresponding plate members 3*a* formed at an edge of the retainer insertion opening 3. More specifically, when only the partial locking claws 5 are located in the retainer insertion opening 3, the plate members 3*a* are held between the partial and full locking claws 5, 6 (partial lock position). The retainer 4 is pushed in after terminal fittings are accommodated into the terminal fitting chambers 2. Then, the full locking claws 6 move over the plate members 3*a* to be engaged with the undersides of the plate members 3*a*, with the result that the retainer 4 is locked in the opening 3. The terminal fittings are insertable and withdrawable into and from the terminal fitting chambers 2 when the retainer 4 is in its partial lock position, whereas they are no longer withdrawable when the retainer 4 is pressed to its full lock position.

The aforementioned prior art connectors may be transported to a location where the terminal fittings are mounted, with the retainers 4 held in the housings 1 in their partial lock positions. During transportation, the retainers 4 may be pressed to their full lock positions upon being struck against something. In such a case, the retainers 4 have to be returned to their partial lock positions using a jig where the terminal fitting mounting operation is performed.

In view of the above problem, an object of the present invention is to provide a connector with a retainer capable of preventing the retainer from displacing its position, in particular from a partial lock position to a full lock position during transportation.

SUMMARY OF THE INVENTION

A connector in accordance with the subject invention comprises a housing and a retainer. The housing is provided with terminal fitting chambers for accommodating terminal fittings and with a retainer insertion opening into which the retainer is insertable. The retainer can be held in a partial lock position and a full lock position with respect to the housing. Detachment of the terminal fittings is possible when the retainer is in its partial lock position. However the retainer securely retains the terminal fittings in its full lock position. The retainer can be locked in and/or operatively released from at least one of its positions.

Thus, according to a preferred embodiment by preventing an inadvertent movement of the retainer from its partial lock position to its full lock position, a connector provided with a retainer is provided which is capable of eliminating a cumbersome work at the location where the terminal mounting operation is performed, as the retainer can be held in one or either position, wherein it can only be displaced on purpose, i.e. by unlocking and/or operatively releasing an engagement with respect to said housing.

Preferably the connector comprises: a housing provided with terminal fitting chambers for accommodating terminal fittings. A retainer which can be held in a partial lock position and a full lock position with respect to the housing, permits the detachment of the terminal fittings in its partial lock position and securely retains the terminal fittings in its full lock position. A locking control member or locking member is provided for preventing a movement of the retainer from the partial lock position to the full lock position. The locking control member may be operable by hand or one finger. Thus, no tools are necessary to allow the retainer to move from the partial lock position to the full lock position.

According to this embodiment, the locking control member prevents the retainer from moving from the partial lock position to the full lock position while the retainer is in the partial lock position. Accordingly, the retainer does not inadvertently move to its full lock position even during transportation. By unlocking the locking control member, the retainer which has permitted the terminal fittings to be accommodated the terminal fitting chambers is permitted to move to the full lock position. In particular the locking control member can be unlocked and/or locked easily and without any special tools.

Further according to a preferred embodiment, the locking control member can be unlocked substantially by inserting the retainer into the retainer insertion opening. Thus, a separate operation of unlocking the locking control member is not necessary.

According to this preferred embodiment of the connector, the housing is provided with a retainer insertion opening into which the retainer is insertable to be retained therein. The locking control member is provided, at its rear end, with respect to an insertion direction of the retainer, with a flexible portion which is so supported as to permit a push-in operation.

Accordingly, the retainer is normally inserted into the retainer insertion opening by pressing the rear end thereof with respect to its insertion direction. Since the flexible portion of the locking control member is supported at the rear end of the retainer so as to permit the push-in operation, if the rear end of the retainer is pressed, the flexible portion is pressed in to permit the movement of the retainer to the full lock position.

Further according to a preferred embodiment, in which the locking control member can be unlocked by simply pushing the flexible portion to deform it in the direction substantially normal to the push-in direction, the locking control member is allowed to have a simplified construction.

According to this embodiment of the connector, the flexible portion is supported at its front end with respect to a push-in direction and is so formed as to be deformable in a direction substantially normal to the push-in direction. A contact projection formed at the flexible portion normally comes into contact with an opening edge of the retainer insertion opening, to make any further insertion of the retainer impossible. However, the contact projection disengages or is manually disengaged from the opening edge of the retainer insertion opening during deformation of the flexible portion, thereby permitting further insertion of the retainer. In particular the locking control member is provided integrally with or hinged to the retainer, and/or the housing.

According to this embodiment, during transportation or like occasion, the contact projection of the flexible portion is in contact with the opening edge of the retainer insertion opening to prevent the movement of the retainer from the partial lock position to the full lock position. Since the flexible portion is supported at its front end with respect to the push-in direction, the rear end thereof is deformable in a direction substantially normal to the push-in direction. Accordingly, if the flexible portion is pressed obliquely downward to the side opposite from the contact projection, the contact projection parts from the opening edge of the retainer insertion opening and the retainer is pressed further down to the full lock position.

Preferably a contact projection is formed at said locking control member, in particular at the flexible or hinged portion. The contact projection is provided to come into contact with the part of an opening edge of the retainer insertion opening, making any further insertion of the retainer impossible.

Further the housing, and in particular the insertion opening, preferably is formed such that the retainer and the locking control member can be accommodated substantially entirely without protruding from the housing, in either the partial lock position or in the full lock position. The connector constructed in this way prevents an unwanted unlocking of the locking mechanism. Further connectors according to this embodiment can be tightly packed during shipping without any risk of changing the retainer position from the partial lock position to the full lock position.

Preferably, the housing comprises a recess for accommodating said contact projection in the full lock position and/or during movement from one position to the other. The recess may be an opening for operatively disengaging the contact projection from said housing. The recess enables the retainer to be held securely in the full lock position. Thus it is possible to release the contact projection from the housing, for instance by inserting a pin, screwdriver or the like into said opening. Thus, means for holding the retainer in the full lock position are provided.

The retainer preferably comprises at least one engaging portion extending substantially perpendicular to the direction of insertion of said retainer into said housing, in particular at least one on each of opposite sides of the retainer. Thus, the retainer can be held operatively and releasably by engagement of the engaging portion with the housing in the partial lock position or the full lock position. In combination with the locking control member, a double action can be obtained, to hold the retainer in the partial lock and/or full lock position.

The retainer preferably is formed with a recess for facilitating the deformation of said engaging portion. In particular the bottom end of the retainer may be forked so as to allow easy deformation of two opposite engaging portions, in particular by simple push-in operation of said retainer.

Preferably the walls of said opening are provided with at least one projection for cooperating with the engaging portion. At least one projection may be provided on each of opposite sides with respect to the retainer, in particular, sides facing to main surfaces of the retainer. By providing the projection, a definite snap-in engagement of the retainer in either position can be provided. This engagement sustains or replaces the action of the locking control member in one or both positions.

The projections on opposite sides are preferably offset in the direction of insertion of said retainer. The offset may be by an amount substantially corresponding to the thickness of said engaging portions. Thus, the retainer can be held in the partial lock position without any play, i.e. one of the engaging portions abuts on the upper side of the lower projection and the other engaging portion abuts against the other, higher projection from below. By further inserting the retainer only the lower projection coacts with one of said engaging portions. Thus, the retainer can be held in the partial lock position by a combined action of the locking control member, in particular the contact projection with the edge or a portion of the edge of the insertion opening, together with the engagement of the engaging portions with the projections at the lower end of the retainer and the housing, respectively. Similarly thereto in the full lock position the engagement of the engaging portion with the projection at the lower end of the retainer and housing, respectively, together with the action of the locking control member provides a secure holding in this position.

The housing may comprise at least one opening for operatively disengaging the engaging portion from the projection, thereby making it possible to operatively release the retainer from the partial lock position or the full lock position.

Finally, it is preferred that the engaging portion, the projection, the opening for operatively disengaging the engagement portion from the projection, the contact projecting and/or the opening for operatively disengaging the contact projection from the housing extend substantially normal to the direction of insertion, in particular substantially parallel to the terminal fitting chambers. Thus, all actions necessary for moving the retainer from the partial lock position to the full lock position and vice versa can either be performed by simple pushing operation of the retainer, or by accessing the retainer via openings, which are provided at the front portion of the housing, adjacent to the terminal fitting chambers.

Further improvements of the inventive connector include the provision of a biasing means, for biasing the retainer towards one of its positions. For example a leaf spring or helicoidal spring can be provided in the housing so as to bias the retainer towards the partial lock position.

Further features and advantages will become apparent from the description of a preferred embodiment in light of the drawings.

DETAILED DESCRIPTION OF THE PREFERRED EMBODIMENT

Hereafter, one embodiment of the invention is described with reference to the accompanying drawings.

Figure 1:
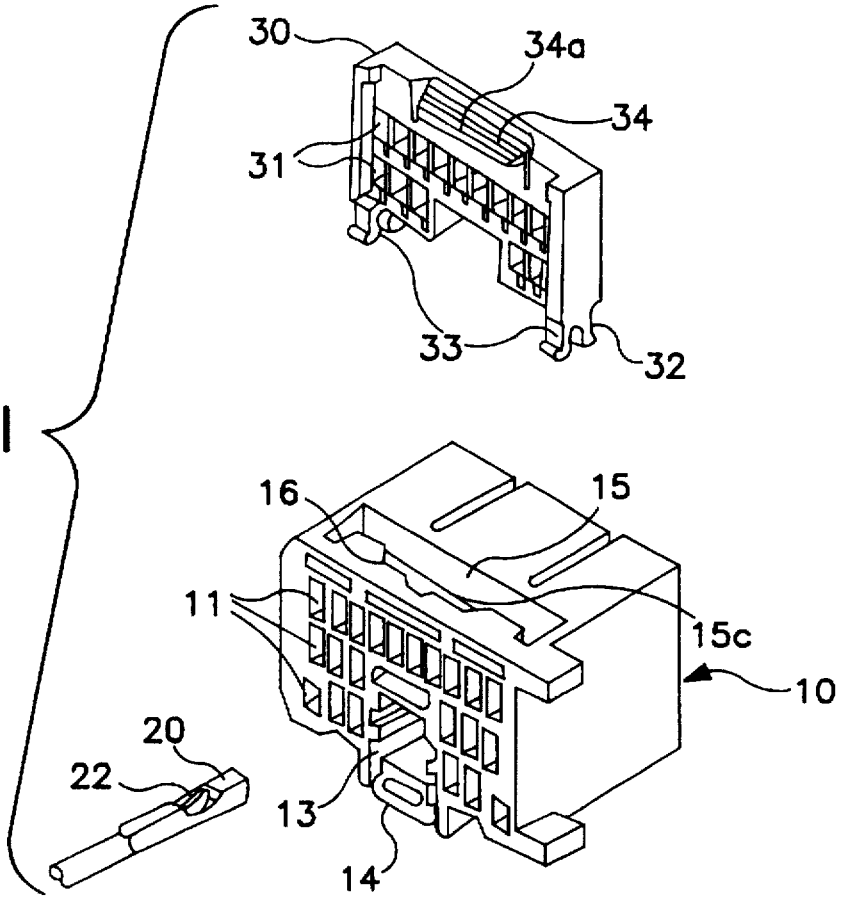
FIG. 1 is an exploded perspective view of a connector provided with a retainer according to one embodiment of the invention.
Figure 2:
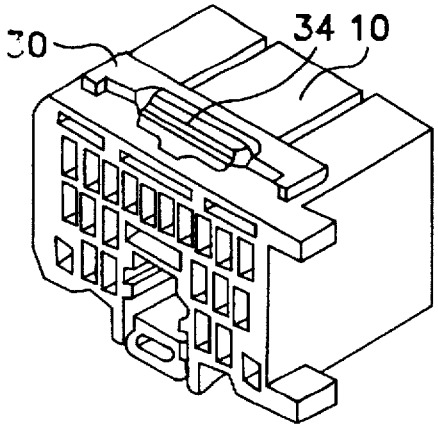
FIG. 2 is a perspective view of the connector with the retainer in its partial lock position.
Figure 3:
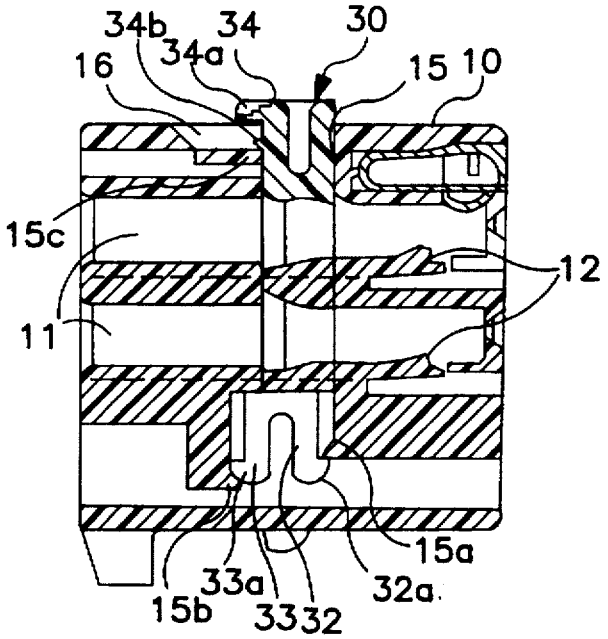
FIG. 3 is a section of the connector with the retainer in its partial lock position.

FIG. 1 is an exploded perspective view of a connector provided with a retainer according to one embodiment of the invention, FIGS. 2 and 3 are a perspective view and a section of the connector when the retainer is in its partial lock position, respectively.

In FIGS. 1 to 3, a substantially rectangular box-shaped housing 10 is formed with a plurality of terminal fitting chambers 11 which extend through the housing 10 along forward and backward directions and are adapted to accommodate female terminal fittings 20. In a front portion of an inner bottom surface of each terminal fitting chamber 11, there is formed a resin lance or engaging portion 12 capable of entering and engaging an engaging hole 21 formed in a bottom surface of the corresponding female terminal fitting 20. A groove 13 oriented in the forward and backward directions is formed substantially in the middle of a lower part of the housing 10, and a locking arm 14 which is connected at a front side and extends backward is formed in the groove 13. Accordingly, the terminal fitting chambers 11 are formed along the vertical and widthwise directions as to circumvent the groove 13.

Although the connector housing is for the female terminal fittings in this embodiment, it may be either for the male terminal fittings or for the female terminal fittings provided that it is formed with terminal fitting chambers for accommodating and retaining the terminal fittings.

The housing 10 is formed with a retainer insertion opening 15 which crosses the respective terminal fitting chambers 11 extending in the forward and backward directions and is open in the upper surface of the housing 10. A substantially lattice-shaped retainer 30 is insertable into the retainer insertion opening 15 while crossing the respective terminal fitting chambers 11. The retainer 30 is formed with windows 31 in positions substantially conforming to the respective terminal fitting chambers 11 so as not to block the terminal fitting chambers 11. The retainer 30 can be held in a full lock position where the retainer 30 is in the bottom-most position in the retainer insertion opening 15 and in a partial lock position which is slightly above the full lock position. With the retainer 30 in its partial lock position, the respective terminal fitting chambers 11 are substantially fully open. However, with the retainer 30 in its full lock position, the ceiling surfaces of the windows 31 are slightly lowered to enter recesses 22 of the female terminal fittings 20, thereby preventing the female terminal fittings 20 from coming out of the chambers 11.

At the bottom end of each of the opposite sides of the retainer 30, engaging portions 32, 33 forked to extend forward and backward, respectively are formed. Outwardly projecting engaging claws **32*a*, 33*a* are formed at the engaging portions 32, 33. In conformity with the engaging portions 32, 33, engaging projections 15*a*, 15*b* are so formed as to be slightly displaced along the vertical direction at the bottom ends of inner front and rear side surfaces of the retainer insertion opening 15. Accordingly, while the retainer 30 is inserted into the retainer insertion opening 15, only the front engaging claws 32*a* move over the front engaging projections 15*a* located slightly higher, and the rear engaging claws 33*a* come into contact with the rear engaging projections 15*b* located slightly lower. In this state, the retainer 30 is held in its partial lock position where it can move neither upward nor downward. If the retainer 30 is further pressed in, the rear engaging portions 33*a* also move over the engaging projections 15*b*, with the result that the retainer 30 is held in its full lock position. In the full lock position, the bottom end of the retainer 30 is in contact with the bottom surface of the retainer insertion opening 15 and, therefore, the retainer 30** cannot move down any further.

The lattice-shaped retainer 30 as described above is so arranged as to cross the terminal fitting chambers 11 in this embodiment. However, any retainer may be used provided that it can be held at least in two positions: one position where it permits the insertion and withdrawal of the terminal fittings and the other position where it prevents the terminal fittings from coming out of the terminal fitting chambers.

A locking control member 34 is formed at a rear side of the middle of the upper end of the retainer 30. The locking control member 34 has a bottom end that is integrally or unitarily connected with the retainer 30 so as to have a flexibility with respect to the forward and backward directions. A finger hook **34*a* is formed at an upper end of the locking control member 34 such that the locking control member 34 can be inclined forward by finger. A projection 34*b* is formed at a base end portion of the finger hook 34*a* facing backward. The locking control member 34 is formed such that the projection 34*b* is in contact with a rear portion of an opening edge 15*c* of the retainer insertion opening 15 when the locking control member 34 is not deformed, while parting from the opening edge 15*c* when the locking control member 34** is deformed to incline forward.

Figure 4:
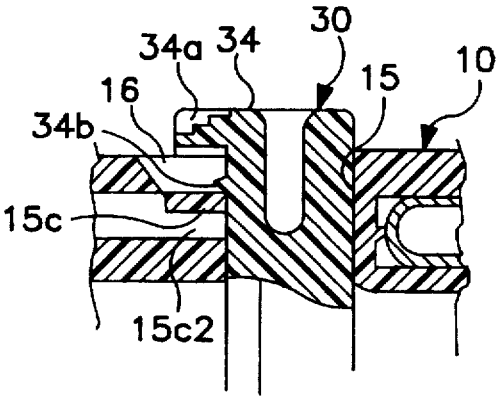
FIG. 4 is a partial enlarged section of the connector.

As enlargedly shown in FIG. 4, the upper surface of the opening edge **15*c* and the lower surface of the projection 34*b* extend substantially in a direction normal to the insertion direction so as to prevent the projection 34*b* from easily moving over the opening edge 15*c*. In the partial lock position, the projection 34*b* is in contact with the opening edge 15*c*. Thus, unless the locking member or locking control member 34 is operated, a movement of the retainer 30** from its partial lock position to its full lock position is prohibited.

In the housing 10, there is formed a recess 16 which communicates with the retainer insertion opening 15 so as to avoid the interference with the finger hook **34*a* extending obliquely downward toward its rear face. Accordingly, the finger hook 34*a* is almost completely located in the recess 16 when the retainer 30 is inserted to the partial lock position, with the result that the finger hook 34*a*** is unlikely to be struck against something.

Although the locking control member 34 is integrally or unitarily formed with the retainer 30 in this embodiment, it may be not necessarily provided at the retainer, but may be provided at the housing 10 provided that it prohibits the movement of the retainer 30 from the partial lock position to the full lock position. However, by forming the locking control member 34 at the retainer 30 to be pushed, an unlocking operation can be done by single hand.

The locking control member 34 itself is formed at the rear end of the retainer 30 with respect to the insertion direction and has flexibility along the forward and backward directions. Accordingly, if the retainer 30 is pushed obliquely downward, the locking control member 34 is unlocked and the retainer 30 is pushed simultaneously by forward and backward components of the pushing force.

Although the locking control member 34 is formed at the rear end of the retainer 30 with respect to the insertion direction to permit a, so-called, press-in operation in this embodiment, it may be of any form provided that it can be unlocked. By unlocking the locking control member 34 by such a press-in operation, the unlocking of the locking control member 34 and the pressing of the retainer 30 can be performed by one operation, thereby improving operability.

The locking control member for permitting the push-in operation is not limited to the one which has a front end connected with the retainer main body and a rear end as a free end having flexibility. A variety of changes are possible. For example, the locking control member may be supported by a rotatable shaft so as to lock and unlock the retainer by its rotation. However, the locking control member which is supported at its front end with respect to a push-in direction enables itself to be integrally or unitarily formed with the retainer 30 and also permits the push-in operation. Therefore, such a locking control member is allowed to have a simplified construction.

Figure 5:
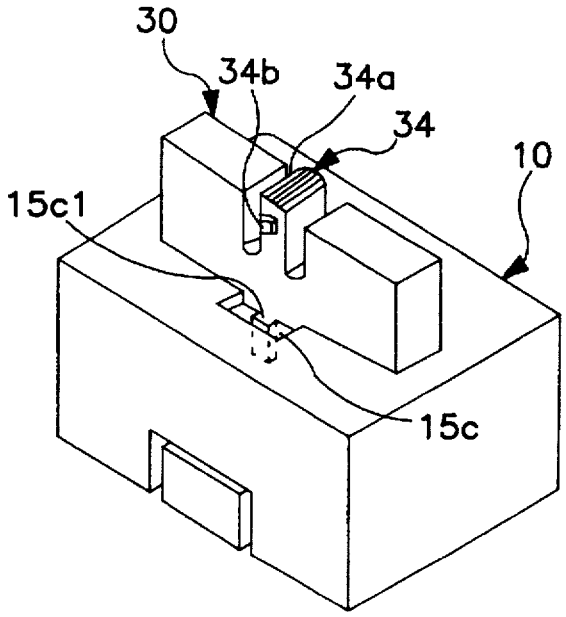
FIG. 5 is a perspective view of a connector provided with a retainer according to a modification.

A construction for supporting the locking control member at its front end may be as shown in FIG. 5. Specifically, the locking control member 34 is so formed as to be deformable along a widthwise direction, and the opening edge 15*c* of the housing 10 is formed with a clearance groove 15*c*1 into which the projection 34*b* is insertable in a deformed position of the locking control member 34. However, when the locking control member 34 faces the rear or front surface, the finger hook 34*a* can be widened, ensuring a larger strength.

Next, the operation of the embodiment constructed as above is described.

While the retainer 30 is inserted into the retainer insertion opening 15, the projections 32*a* of the engaging portion 32 move over the engaging projections 15*a* of the retainer insertion opening 15, thereby bringing the retainer 30 to its partial lock position. At this stage, the projection 34*b* of the locking control member 34 is in contact with the opening edge 15*c* as shown in FIGS. 2 to 4. Since the planar portion of the projection 34*b* and the planar portion of the opening edge 15*c* are in contact with each other in this state, the retainer 30 will not be pushed in even if a force which acts to push it in is exerted thereon during transportation. Since the finger hook 34*a* is almost completely located in the recess 16 at this stage, there is no likelihood that something comes into direct contact with the finger hook 34*a* to push it in.

Figure 6:
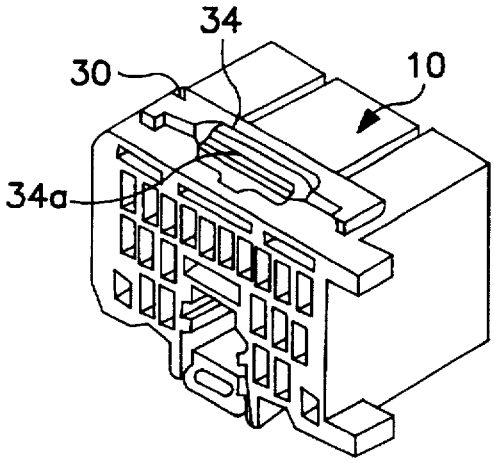
FIG. 6 is a perspective view of the retainer during a push-in operation.
Figure 7:
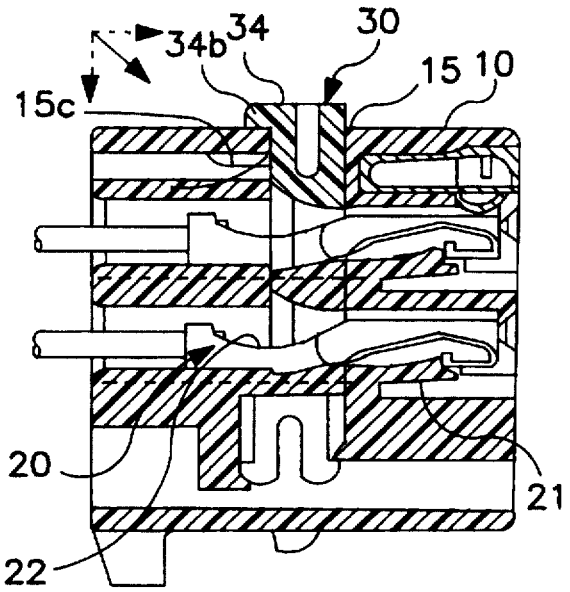
FIG. 7 is a section of the connector.
Figure 8:
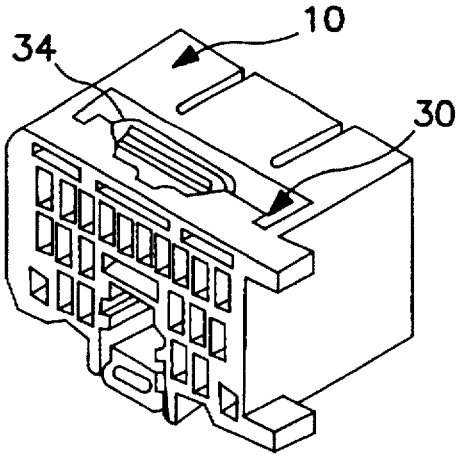
FIG. 8 is a perspective view of the connector with the retainer in its full lock position.
Figure 9:
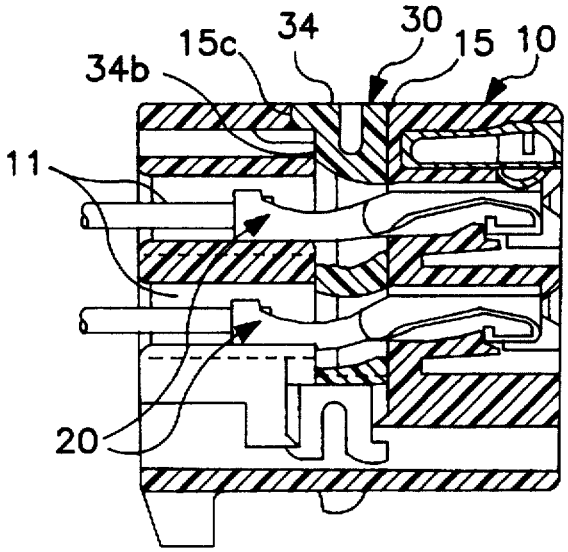
FIG. 9 is a section of the connector.
Figure 10:
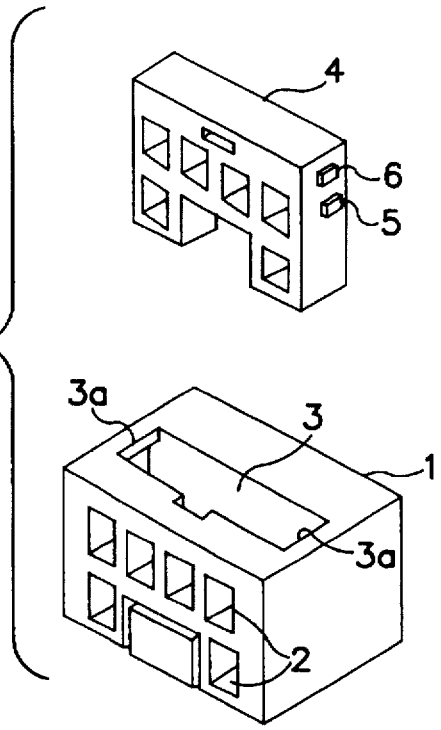
FIG. 10 PRIOR ART
FIG. 10 is a perspective view of a prior art connector provided with a retainer.
Figure 11:
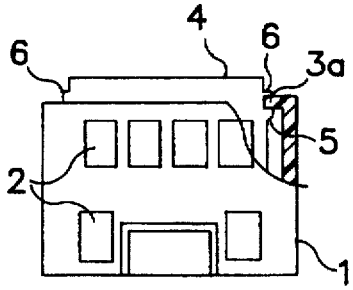
FIG. 11 PRIOR ART
FIG. 11 is a rear view partly in section of the prior art connector with the retainer in its partial lock position.
Figure 12:
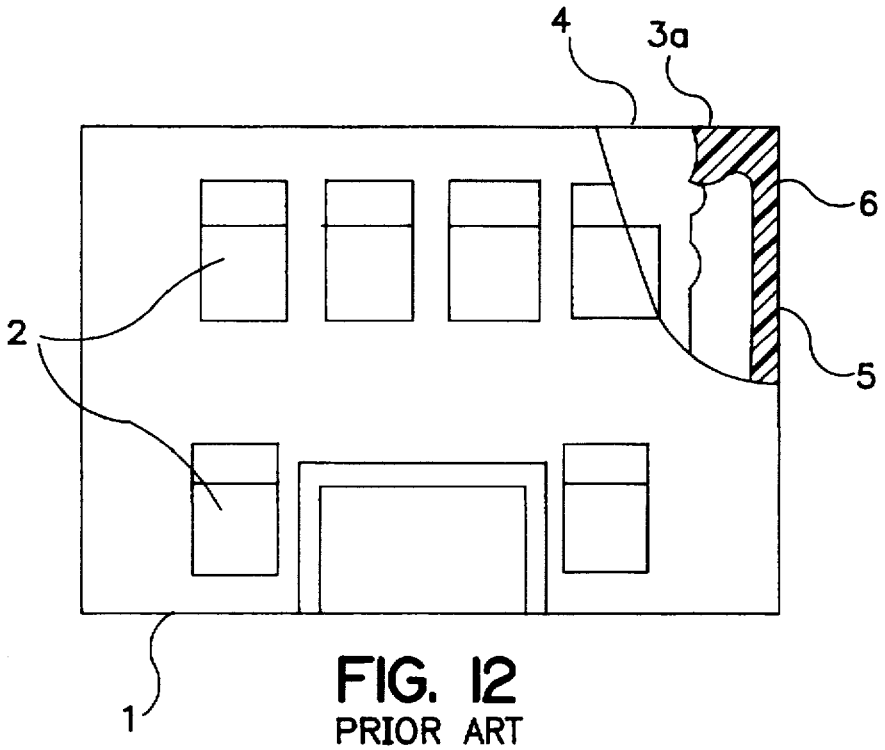
FIG. 12 PRIOR ART
FIG. 12 is a rear view partly in section of the prior art connector with the retainer in its full lock position.

If the locking control member 34 is pushed slightly obliquely downward to the front after the female terminal fittings 20 are inserted, it is deformed to the front, as shown in FIGS. 6 and 7, by the forward acting component of the push-in force. Then, the projection 34*b* parts from the opening edge 15*c*, and the locking control member 34 is pushed down, as shown in FIGS. 8 and 9, by the downward acting component of the push-in force, with the result that the retainer 30 moves from its partial lock position to its full lock position. Since the opening edge 15*c* is formed by a plate and a space is defined below it, the projection 34*b* of the locking control member 34 is locked in this space when the retainer 30 is in its full lock position.

As described above, in the connector provided with the retainer 30 which can be held displaceably from the partial lock position to the full lock position with respect to the housing 10, the locking control member 34 is provided to prevent an inadvertent movement of the retainer 30 from the partial lock position to the full lock position. Accordingly, even upon being struck against something during transportation, the retainer 30 does not move from the partial lock position to the full lock position.

What is claimed is:

1. A connector comprising:

a housing (10) and a retainer (30), the housing (10) being provided with terminal fitting chambers (11) for accommodating terminal fittings (20) and with a retainer insertion opening (15) into which the retainer (30) is insertable for retention therein, the retainer (30) having engaging means engageable with the housing (10) for selectively holding the retainer (30) in a partial lock position and a full lock position with respect to the housing (10), said retainer (30) being configured for detachment of the terminal fittings (20) when retainer (30) is in its partial lock position and for securely retaining the terminal fittings (20) in the housing (10) when the retainer (30) is in its full lock position, and wherein said retainer (30) further comprising a locking control member (34) for preventing movement of the retainer (30) from the partial lock position to the full lock position, said locking control member (34) including a manual actuator for selectively releasing the locking control member (34) to enable movement of the retainer (30) to the full lock position, the locking control member (34) being provided at a rear end of the retainer (30) with respect to an insertion direction of the retainer (30) and being provided with a flexible portion in the form of a cantilevered arm projecting rearwardly with respect to the insertion direction for deflection in a direction substantially normal to the insertion direction to permit a push-in operation of the retainer (30).

2. A connector according to claim 1, wherein a contact projection (34*a*, 34*b*) is formed at the flexible portion of said locking control member (34) and is dimensioned to come into contact with a part of an opening edge (15*c*, 16) of the retainer insertion opening (15) making any further insertion of the retainer (30) impossible prior to deflection of the locking control member (34).

3. A connector according to claim 1, wherein said insertion opening (15) of said housing (10) is formed such that the retainer (30) and said locking control member (34) can be accommodated substantially entirely, without protruding from said housing (10), in the full lock position.

4. A connector according to claim 3, wherein said housing (10) comprises a recess (15*c*1; 15*c*2) for accommodating said contact projection (34*a*, 34*b*) in the full lock position, and during movement from one position to the other, said recess (15*c*1; 15*c*2) being an opening (15*c*2) for operatively disengaging said contact projection (34*a*, 34*b*) from said housing (10).

5. A connector according to claim 1, wherein the retainer (30) comprises at least one engaging portion (32, 33) on each of opposite side of said retainer (30) and extending substantially perpendicular to the direction of insertion of said retainer (30) into said housing (10) said engaging portions (32, 34) being engageable with the housing (10) in at least one of the lock positions.

6. A connector according to claim 5, wherein the retainer (30) is formed with a recess for facilitating deformation of said engaging portion (32, 33).

7. A connector according to claim 5, wherein walls of said housing (10) defining said opening (15) are provided with at least one projection (15*a*, 15*b*) for cooperating with and engaging said engaging portion (32, 33).

8. A connector according to claim 7, comprising at least two said projections (15*a*, 15*b*) disposed respectively on opposite sides of said opening (15) and being offset in the direction of insertion of said retainer (30) into said opening (15) in said housing (10).

9. A connector according to claim 8, wherein said housing (10) comprises at least one opening for operatively disengaging said engaging portion (32, 33) from said projection (15*a*, 15*b*).

10. A connector according to claim 9, wherein said engaging portion (32, 33), said projection (15*a*, 15*b*), said opening for operatively disengaging said engaging portion (32, 33) from said projection (15*a*, 15*b*), said contact projection (34*a*, 34*b*) and said opening for operatively disengaging said contact projection (34*a*, 34*b*) from said housing (10) extend substantially normal to the direction of insertion, and substantially parallel to said terminal fitting chambers (11).

* * * * *